US006752006B2

(12) United States Patent
Rizzoli et al.

(10) Patent No.: US 6,752,006 B2
(45) Date of Patent: Jun. 22, 2004

(54) DEVICE FOR THE PNEUMATIC INSPECTION OF SMOKING ITEMS

(75) Inventors: Salvatore Rizzoli, Bologna (IT); Fulvio Boldrini, Ferrara (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 10/113,576

(22) Filed: Apr. 2, 2002

(65) Prior Publication Data

US 2002/0144540 A1 Oct. 10, 2002

(30) Foreign Application Priority Data

Apr. 4, 2001 (IT) ..... BO2001A0203

(51) Int. Cl.[7] ..... G01M 3/02
(52) U.S. Cl. ..... 73/37; 73/38; 73/40; 73/41
(58) Field of Search ..... 73/37, 38, 40, 73/41

(56) References Cited

U.S. PATENT DOCUMENTS 3,948,084 A 4/1976 Heitmann et al. ..... 73/41
3,962,906 A 6/1976 Heitmann et al.
4,325,250 A 4/1982 Bolt et al.
4,471,650 A 9/1984 Koch ..... 73/41
4,630,466 A 12/1986 Berlin ..... 73/38
4,888,977 A * 12/1989 Chehab et al. ..... 73/38

FOREIGN PATENT DOCUMENTS

EP 0584773 3/1994 ..... 73/37
GB 1597510 9/1981 ..... 73/37

* cited by examiner

*Primary Examiner*—Daniel S. Larkin
(74) *Attorney, Agent, or Firm*—Davidson Berquist Klima & Jackson, LLP

(57) ABSTRACT

A device for the pneumatic inspection of cigarettes comprises a roller which turns about an axis of rotation and has a plurality of seats, each designed to receive a cigarette. For each seat the device has a pair of caps made of strong material, designed to connect with the ends of the cigarette in such a way that, at an inspection station, each cigarette is connected to a source of a fluid which can subject the cigarette to the action of the fluid. A pneumatic—electric pressure transducer is connected to each seat. The transducer issues a signal which depends on the action of the fluid and which indicates the state of the cigarette.

8 Claims, 6 Drawing Sheets

DEVICE FOR THE PNEUMATIC INSPECTION OF SMOKING ITEMS

BACKGROUND OF THE INVENTION

The present invention relates to a device for the pneumatic inspection of smoking items, in particular cigarettes.

Along cigarette packaging and conditioning lines, in particular in filter tip attachment machines, devices are installed which can carry out pneumatic inspections on the cigarettes, both to check the correct degree of ventilation for so-called ventilated cigarettes, which have ventilation holes, normally made using laser ray devices, and to check that the cigarettes have been assembled correctly and their component parts are in good condition.

Known inspection devices of this type normally comprise a conveyor, usually consisting of a rotary drum with a succession of radial seats designed to receive and hold cigarettes by suction. The drum normally operates in conjunction with and is integral with a plurality of pneumatic circuits whose ends are located at the ends of each cigarette and are designed so that, during rotation of the drum and at a pneumatic inspection station, they make contact and form a seal with the ends of the cigarettes, which are in this way inserted in the pneumatic circuits. The pneumatic circuits are supported by two disks positioned on opposite sides of the drum and coaxial with it. At the inspection station the infeeds are connected to a source of inspection fluid, whilst the outfeeds are connected to a pneumatic—electric transducer which is outside and fixed relative to the drum and the disks. The transducer can transform the pressure value detected into a corresponding electrical signal, which is processed in such a way as to check the correct degree of ventilation and/or correct cigarette assembly.

The connection between the rotary pneumatic circuits and the fixed transducer is obtained using a graphite pad with a passage for the inspection fluid which allows the connection to be made without drops in the pressure. However, it has been found that the pad tends to wear in relatively short periods, causing a loss of seal and, during wear produces residual powders which tend to dirty the inspection fluid passage, making the processing system response unreliable.

There are also known pneumatic inspection devices comprising, at the inspection station, and alongside the outer surface of the drum, a suction hood with a first portion which is smaller than the longitudinal dimensions of the cigarettes and a second portion which is substantially the same size as the longitudinal dimensions of the cigarettes. In this way, the inside of the hood, at each seat which passes through its portions, creates two different and successive ambient conditions. As a result, a first measurement is taken by subjecting each cigarette to a given pressure, with the exception of its end, which is left at atmospheric pressure, and a second measurement is taken by subjecting the entire cigarette to a given pressure. The ratio between these two measurements, compared with a preset value, leads to the processing of a signal which indicates the condition of the cigarettes and controls a device which rejects any faulty cigarettes.

This device has proved unreliable at high speeds due to the relatively lengthy periods required by the hood to create the two different ambient conditions inside it. Moreover, if said ambient conditions are upset by the absence of a cigarette inside a seat, the hood has proved itself unable to re-establish the balanced ambient conditions in relatively short periods.

The aim of the present invention is to overcome the above-mentioned disadvantages.

SUMMARY OF THE INVENTION

Accordingly, the present invention provides a device for the pneumatic inspection of smoking items, comprising a conveyor which has a plurality of seats, each designed to receive an item, and pneumatic fluid generator means which can be connected to said seats at an inspection station, so as to subject the item to the action of the fluid, and wherein each seat is connected to a pressure transducer which issues at least one signal depending on the action of the fluid and which indicates the condition of the smoking item.

BRIEF DESCRIPTION OF THE DRAWINGS

The present invention is now described with reference to the accompanying drawings, which illustrate several preferred embodiments without limiting the scope of application, and in which.

DESCRIPTION OF THE PREFERRED EMBODIMENTS

Figure 1:
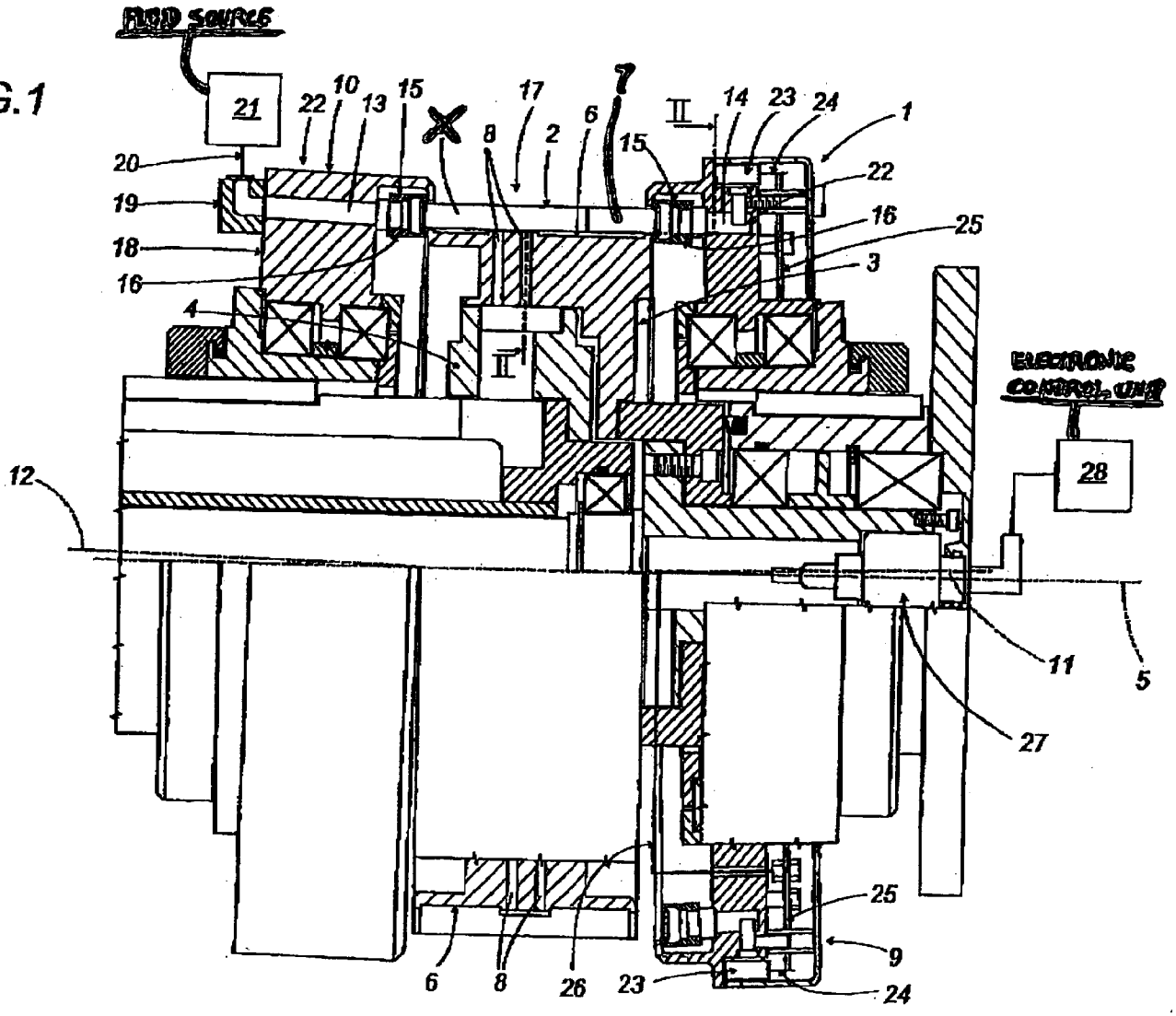
FIG. 1 is a schematic side cross-section with some parts cut away, of a first embodiment of a pneumatic inspection device.
Figure 5:
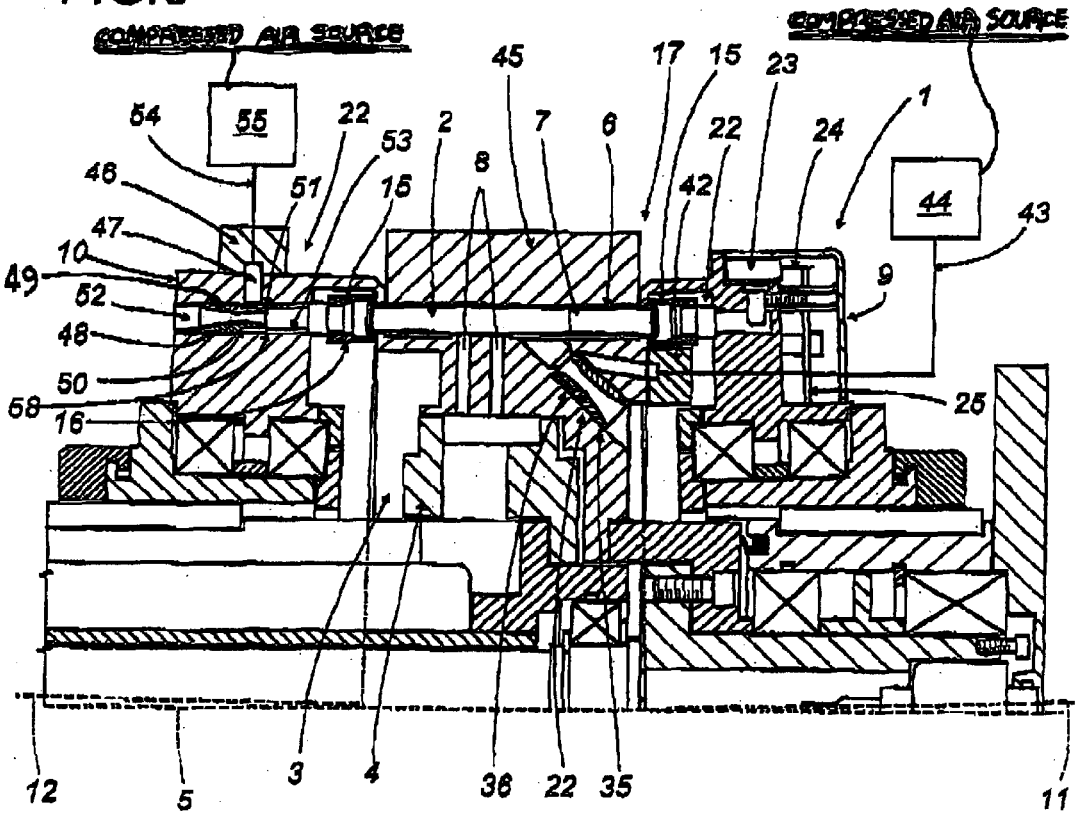
FIG. 5 is a schematic side view of a third embodiment of the device illustrated in FIG. 1.
Figure 9:
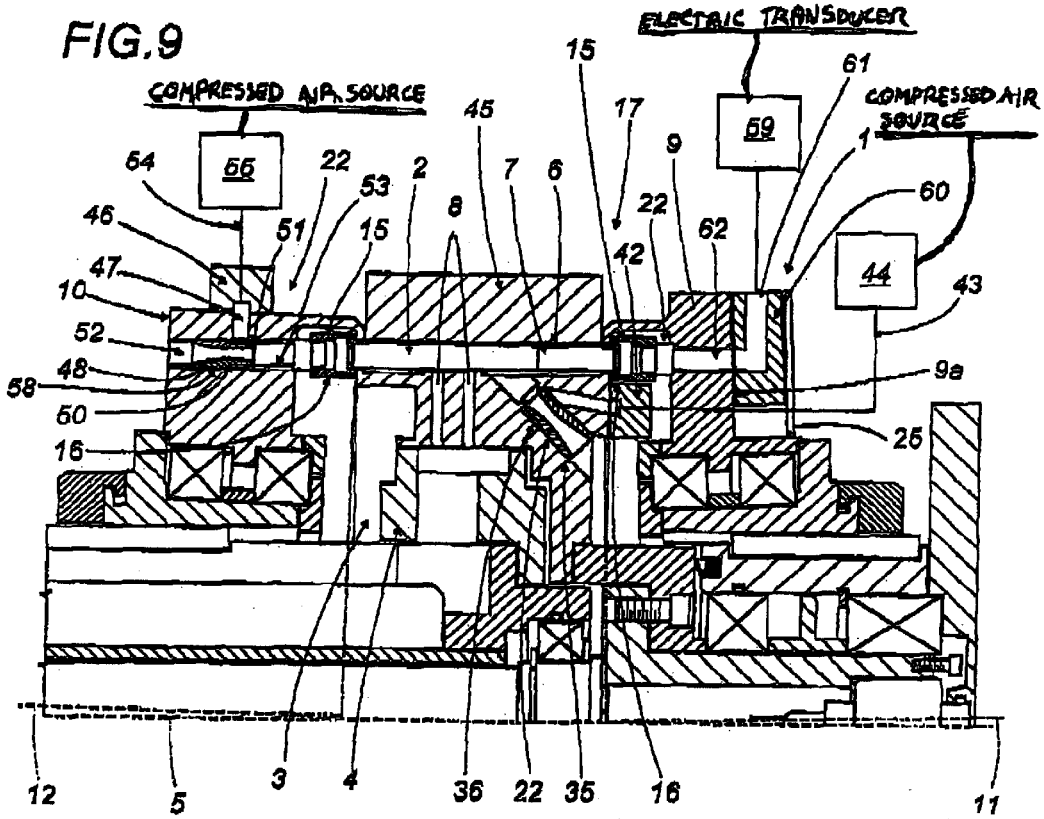
FIG. 9 is a schematic side cross-section with some parts cut away of a second embodiment of a pneumatic inspection device.

With reference to FIGS. 1, 5, and 9, the numeral 1 indicates as a whole a device for the pneumatic inspection of smoking items, for example cigarettes 2, comprising a conveyor 3 which, for example, consists of a roller 4 which turns about a horizontal axis 5.

The device 1 is part of a filter tip attachment machine, not illustrated, and the roller 4 has equidistant peripheral seats 6 which turn parallel with the axis 5, each designed to hold a cigarette 2 with a filter tip 7 and to retain it using suction means of the known type and not illustrated which communicate with the outside through substantially radial ducts 8.

On both sides of the roller 4 and integral with it, there are two disks 9 and 10 which are identical and symmetrical with one another. In the embodiment illustrated in FIGS. 1, 5, and 9, the disks 9 and 10 are mounted on axes 11 and 12 which are at an angle to the axis 5.

In the embodiment illustrated in FIG. 1, each seat 6 on the edge of the disk 10 has a through hole 13 whose axis is substantially parallel with the axis of rotation 12, whilst each seat 6 on the edge of the disk 9 has a hole 14. Each hole 13 and each hole 14 has, on the side facing the seat 6, connecting means, labeled 15 as a whole and comprising end caps 16 made of an elastic material. As a result of the reciprocal inclination of the disks 9 and 10, the caps 16 make contact and form a seal with the opposite ends of each cigarette 2 with a filter tip 7 at an inspection station 17, at the minimum reciprocal distance between the connecting means 15 and substantially equal to the length of each cigarette 2. Specifically, the cap 16 supported by the disk 9 is designed to connect with the end of the filter tip 7, whilst the cap 16 supported by the disk 10 is designed to connect with the end of the cigarette 2.

At the inspection station 17, as the disk 10 turns about its axis 5, it forms an airtight sliding connection between the ends of each through hole 13, facing its outer surface 18, opposite that facing the roller 4, and a fixed pneumatic distributor 19 which is connected, by a duct 20, to a source 21 of fluid and, by the through holes 13, to each of the caps 16.

The distributor 19, together with the holes 13 and the source 21 of the fluid, is part of the pneumatic fluid generator means labeled 22 as a whole, and in particular the distributor 19 extends over a given section at the inspection station 17.

Figure 2:
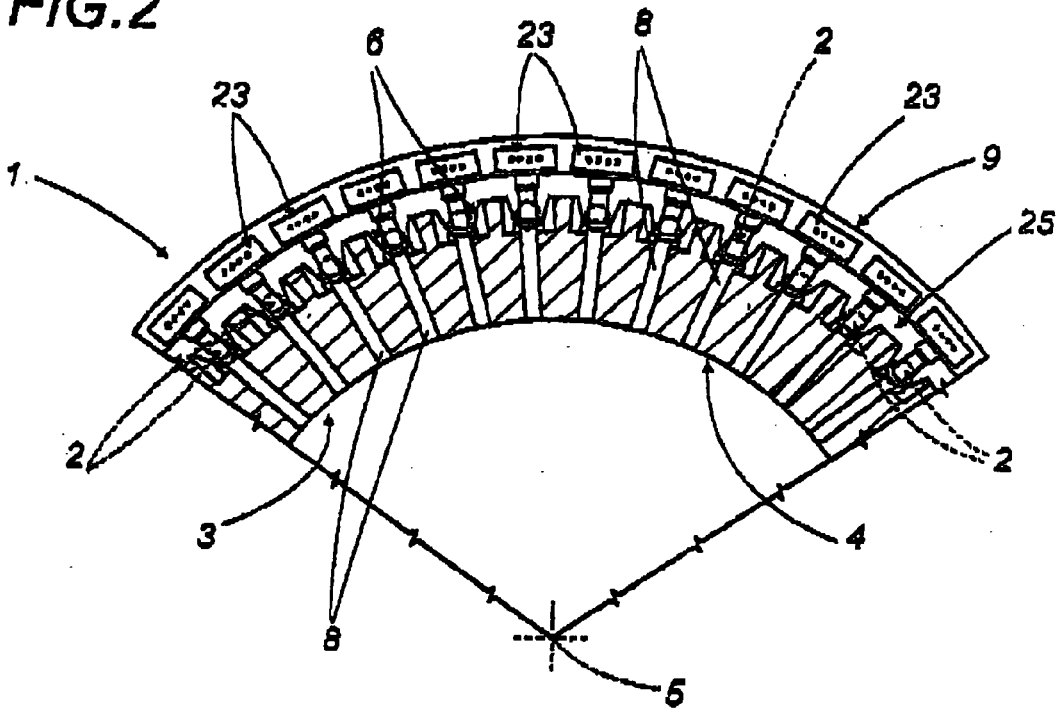
FIG. 2 is the cross-section of FIG. 1 along line II—II.

As illustrated in FIGS. 1 and 2, at each hole 14 on the disk 9 a first end of a pneumatic—electric transducer 23 is inserted and, as a result, is pneumatically connected to each seat 6, at the inspection station 17 and by means of a cap 16. Therefore, the pneumatic—electric transducers 23, their number equal to that of the seats 6 in the roller 4, are supported by a single, shared conveyor consisting, in the case in question, of the disk 9 which moves in such a way that it is synchronized with the roller 4. The second end of each transducer 23 has a leg 24 connected to a shared manifold forming a shared circuit and comprising a disk-shaped card 25 coaxial and integral with the disk 9 and, in turn, connected to a direct cable 26 with a first section radial to the disk 9 and a second section following the axis 5 of rotation of the roller 4 and leading to a rotary distributor 27, of the known type, coaxial with the roller 4 and a fixed part of whose output is connected to an electronic control unit 28 for receiving and processing the signals from the transducers 23 which indicate the condition of the cigarettes 2.

In practice, the cigarette 2 transfer roller 4 and the two disks 9 and 10 are turned, the former about the axis 5 and the latter about the axes 11 and 12, by motor means which are not illustrated. As a result of the inclination of the disks 9 and 10, at the inspection station 17 the caps 16 connect with the opposite ends of each cigarette 2 which is, in this way, inserted in an airtight fashion in a pneumatic circuit which is part of the pneumatic generator means 22. The pneumatic circuit is connected at one end to the fluid source 21 and at the other end to the pneumatic—electric transducer 23, which issues a signal that depends on the pressure inside the circuit and indicates the condition of the cigarette 2. Through the legs 24, disk—shaped card 25, cable 26, and rotary distributor 27, the signal arrives at the control unit 28, which can both activate a rejection device, not illustrated, and modify the operation of the packaging line which includes the roller 4.

Figure 3:
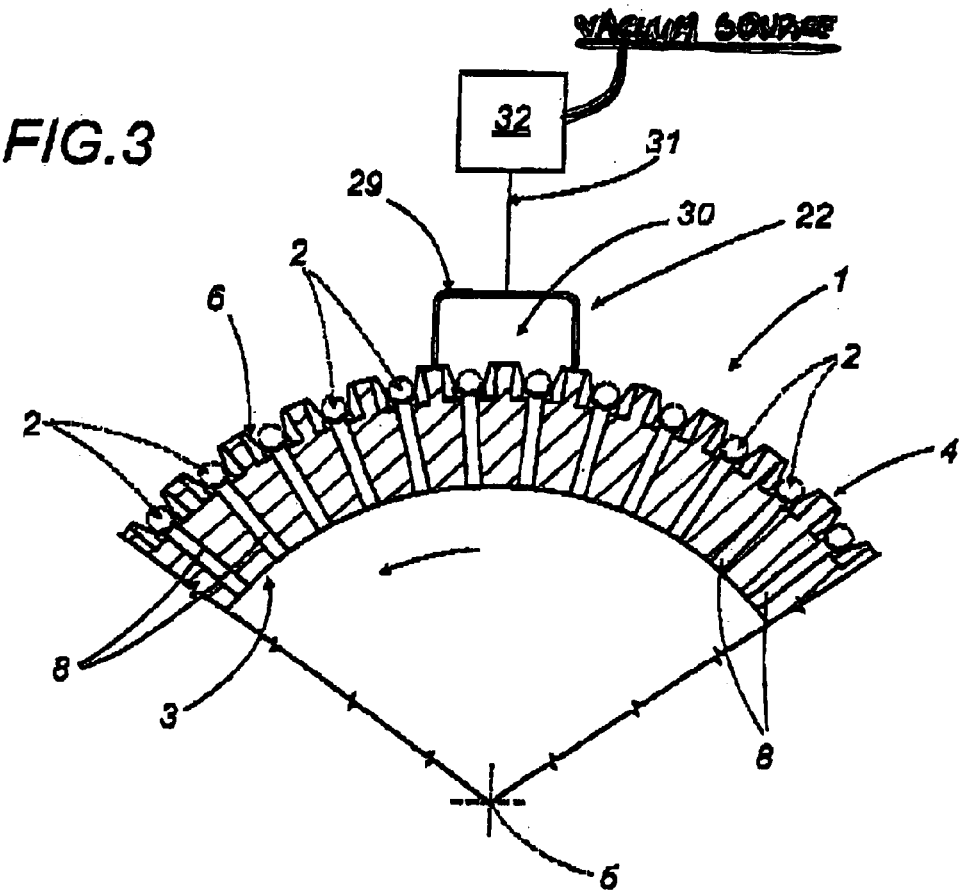
FIG. 3 is a schematic side view with some parts in cross-section and others cut away, of a second embodiment of a detail of the device illustrated in FIG. 1.
Figure 4:
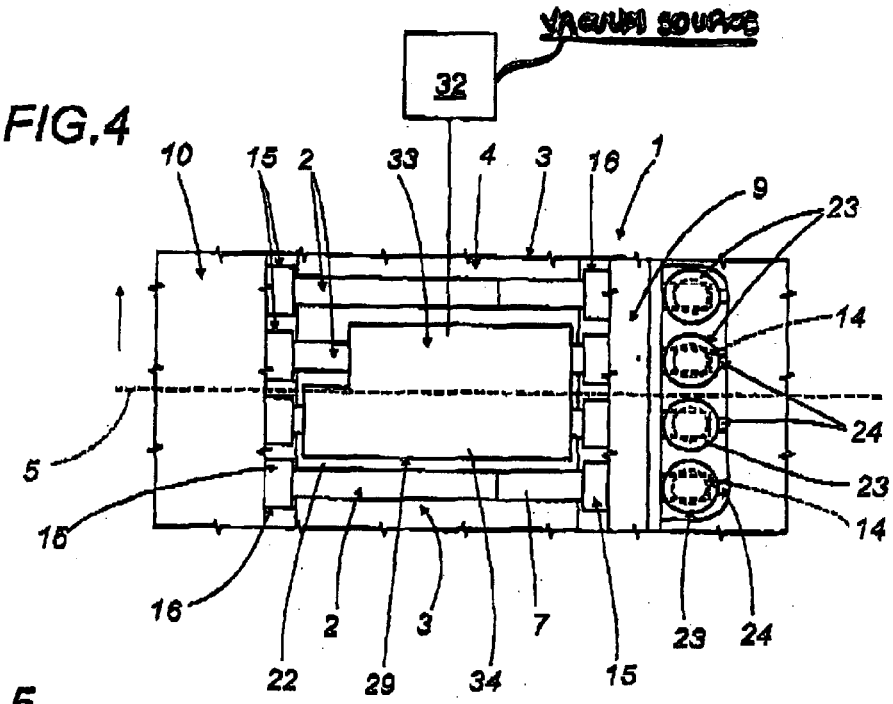
FIG. 4 is a top plan view of the detail illustrated in FIG. 3.

In the embodiment illustrated in FIGS. 3 and 4, at the inspection station 17 the through holes 13 communicate with the outside environment, leaving the ends of the cigarettes 2 at atmospheric pressure and the pneumatic generator means 22 comprise a fixed covering hood 29 which is cyclically connected to two consecutive seats 6 on the roller 4 and, together with the latter, forms a chamber 30 which closes the two seats 6. The chamber 30 is connected by a duct 31 to a source 32 of fluid, which in the case in question is a source of fluid subject to a vacuum. In particular, as illustrated in FIG. 4, the hood 29 extends in two separate portions according to the direction of rotation of the roller 4, anti-clockwise in FIG. 3.

Specifically, the hood 29 comprises a first portion 33 whose longitudinal length parallel with the length of the seats 6 is smaller than the longitudinal dimensions of the cigarette 2, leaving free the end of the cigarette opposite that connected to the pneumatic—electric transducer 23, and a second portion 34, with dimensions equal to or larger than the longitudinal dimensions of the cigarette 2, so that it covers both ends of the cigarette 2.

In practice, when the roller 4 turns at the inspection station 17, each seat 6 reaches the chamber 30 and is first subjected to the vacuum created by the source 32 inside the first portion 33 of the hood 29 and then subjected to the vacuum created inside the second portion 34. Then the cylindrical body of each cigarette 2 present in the two adjacent seats inside the chamber 30 is subjected, at the inspection station 23, to a variation in the ambient pressure and the transducer 17 of a single seat detects two different pressure conditions which are transformed into electrical signals and sent, using the methods described relative to the previous case, to the control unit 28.

Figure 6:
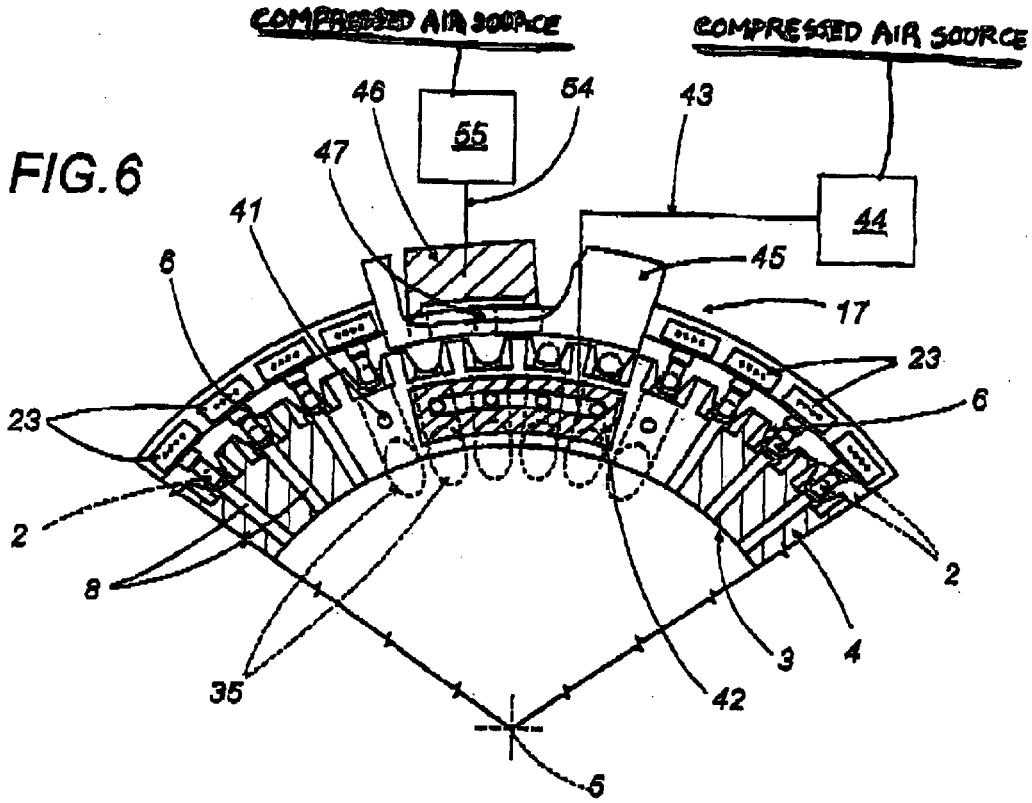
FIG. 6 is a schematic front view with some parts cut away and others in cross-section of a part of the device illustrated in FIG. 5.
Figure 7:
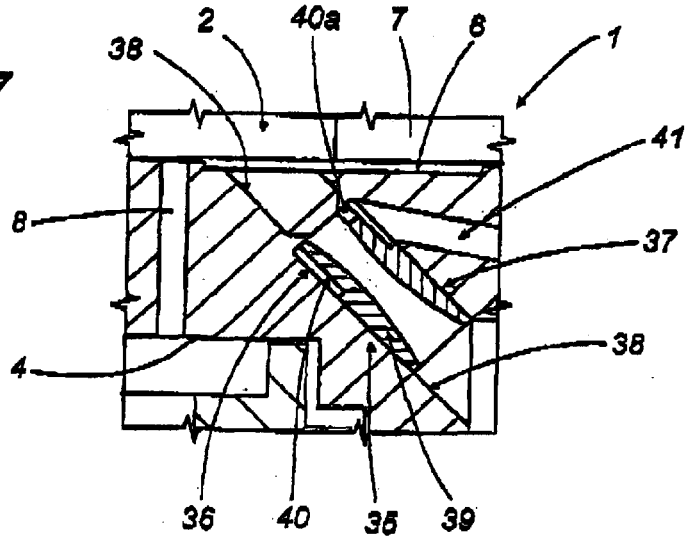
FIG. 7 is a scaled up view of a detail illustrated in FIG. 5.
Figure 8:
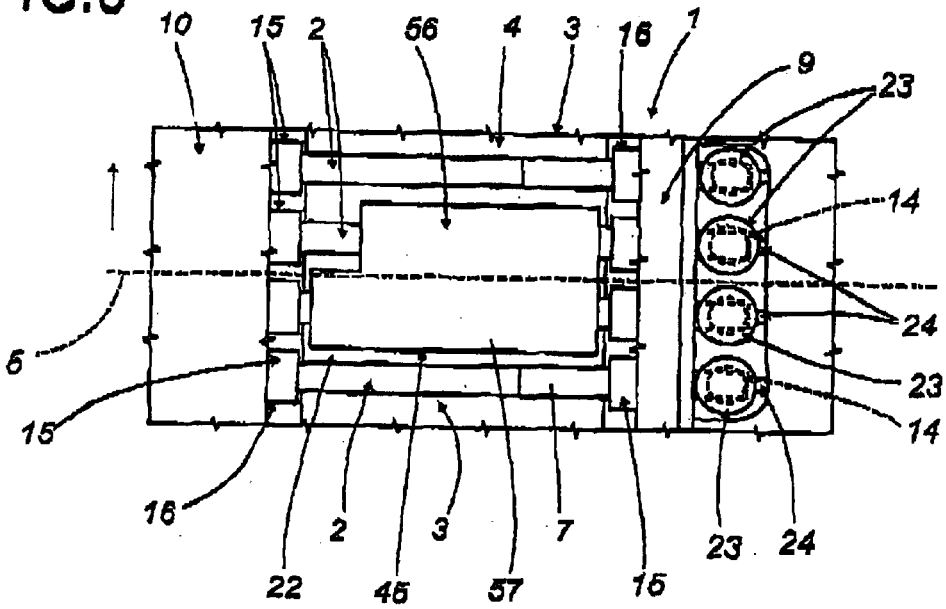
FIG. 8 is a top plan view with some parts cut away, of the part of the device from FIG. 5 illustrated in FIG. 6.

In the embodiment illustrated in FIGS. 5, 6 and 8, the pneumatic generator means 22 comprise, attached to each seat 6 and on the roller 4, a first pneumatic connecting means labeled 35 as a whole and comprising first Venturi—effect pneumatic transformation means 36. As illustrated in FIG. 7, the first pneumatic transformation means 36 in turn comprise a tubular nozzle 37 which is part of duct 38 passing through the roller 4, its first end opening into the seat 6 and a second end opening to the outside. The nozzle 37 comprises a tubular body 39 with a substantially intermediate constriction forming a Venturi tube and a ring-shaped chamber 40 surrounding the tubular body 39 and having a radial hole 40*a*. The chamber 40, close to the hole 40*a*, is connected to one end of a duct 41 which is designed to connect in an airtight fashion at its other end to first fixed manifold means 42 (FIG. 5), which are part of the pneumatic generator means 22, located at the inspection station 17 and connected, by a duct 43, to a first source of compressed air 44.

At the inspection station 17, there is also a fixed covering panel 45 which substitutes the hood 29 connected to the source 32 of fluid and illustrated in FIGS. 3 and 4, and is coaxial to the roller 4 and designed to close the top of the seats 6.

The fluid generator means 22 comprise second fixed manifold means 46 connected with an airtight seal to the disk 10 and designed to connect with an airtight seal, at the inspection station 17, to a first end of a duct 47 which opens into second Venturi—effect pneumatic transformation means 48, identical to the first means 36. Specifically, the second means 48 comprise a nozzle 49 comprising a tubular body 50 with a substantially intermediate constriction forming a Venturi tube and a ring-shaped chamber 51 surrounding the tubular body 50 and into which the duct 47 opens. The nozzle 49 is located inside a duct 52 which passes through the disk 10 to substitute the through holes 13. The first end opens to the outside and the second end faces the seats 6. The through duct 52, by means of a sleeve 53, opens into a cap 16 which is part of the connecting means 15 designed to connect to the end of a cigarette 2. Finally, the second manifold means 46 are connected by a duct 54 to a second source 55 of compressed air.

As illustrated in FIG. 8, the panel 45 comprises a first portion 56, smaller than the longitudinal dimension of a cigarette 2 and covering the first of the two seats 6 on which the panel 45 operates, and a second portion 57, of a size substantially equal to the longitudinal dimension of the cigarette 2 and designed to cover the second of the two seats 6.

As illustrated in FIG. 6, the first and second manifold means 42, 46 extend in arced sections with different amplitude, and the amplitude of the first manifold means 42 is greater than the amplitude measured on the same arc of the second manifold means 46. Both manifold means 42 and 46 have their end sections, according to the direction of rotation of the roller 4, radially aligned with one another. The angular travel of the first manifold means 42 is such that it covers at least four seats 6, whilst the angular travel of the second manifold means 46 covers at least two seats 6.

It should be indicated that the duct 47, the second Venturi—effect pneumatic transformation means 48, the through duct 52, made in the disk 10, and the sleeve 53 by means of which the through duct 52 opens into a cap 16 which is part of the connecting means 15 designed to connect with the end of a cigarette 2, together form the second pneumatic connecting means labelled 58 in FIGS. 5 and 9.

In practice, immediately upstream of the inspection station 17, when the roller 4 turns, firstly the ducts 41 are connected by the first manifold means 42 to the first compressed air source 44 which, by issuing a jet of air towards the ring-shaped chamber 40 and by means of the nozzle 37 generates a vacuum inside the seat 6 by Venturi effect and in conjunction with the covering panel 45, creating a vacuum environment on each cigarette 2 except the end of the cigarette facing the disk 10. The seat 6 in this vacuum condition reaches the inspection station 17 and by means of the caps 16 the cigarette is inserted in an airtight fashion in a pneumatic circuit which is part of the pneumatic generator means 22 and connected at one end facing the disk 9 to the pneumatic—electric transducer 23 which issues a first signal which depends on the pressure in the circuit and which indicates the conditions of the cigarette 2. The first signal passes through the legs 24, the disk—shaped card 25, the cable 26, and rotary distributor 27 to the control unit 2B which can save it.

Then, the duct 47 of the seat 6 considered is connected, by the second manifold means 46, to the second source 55 of compressed air which, by issuing a jet of air towards the ring—shaped chamber 51 and by means of the nozzle 49, generates a vacuum by Venturi effect and in conjunction with the cap 16, even at the end of the cigarette 2 facing the disk 10.

At the same time, the pneumatic—electric transducer 23 issues a second signal which depends on the pressure inside the circuit, formed by the first and second manifold means 42, 46 and indicating the conditions of the cigarette 2. The second signal passes through the legs 24, the disk—shaped card 25, the cable 26, and rotary distributor 27 to the control unit 28 which can save it and compare it with the first signal. The ratio between the two signals is used to establish the degree of integrity of the cigarette and, therefore, whether or not it must be rejected.

It is useful to emphasize that the fact that the angular travel of the first manifold means 42 is of a length which covers at least four seats 6, with the angular travel of the second manifold means 46 covering at least two seats 6, allows greater stabilization of the vacuum in the seats 6 and this stability remains, whatever the conveyor 3 speed of rotation, for a period which is longer than that if the two manifolds were to cover two seats 6 and one seat respectively. This basically allows more time for taking the measurement, and allows the vacuum system to remain stable, without being affected by the transients of the previous measurements or objectively necessary in order to reach the desired pressure value in each case.

Figure 10:
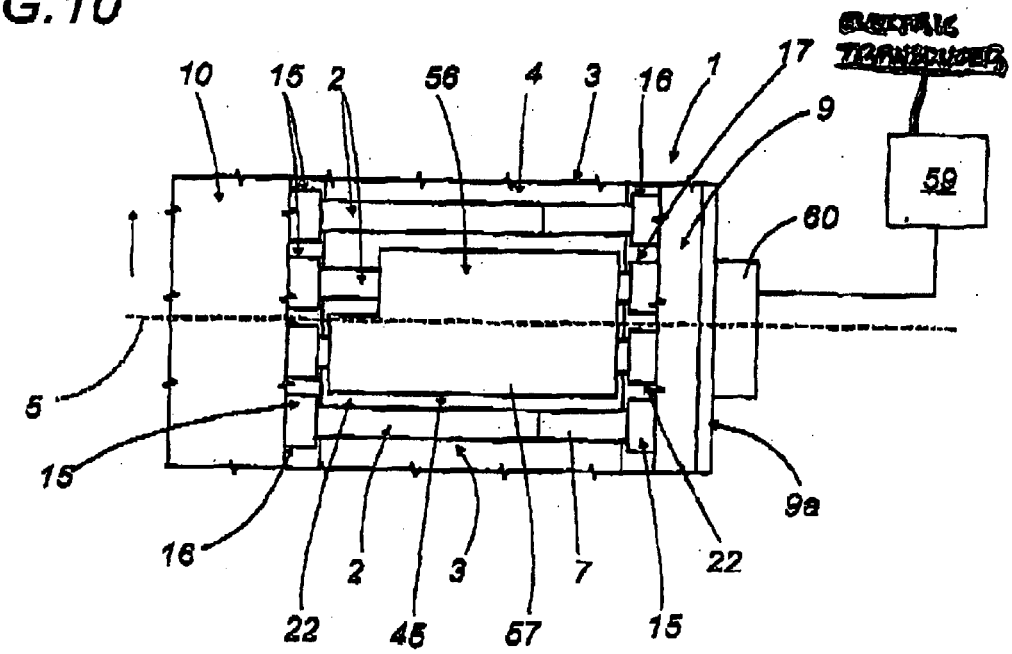
FIG. 10 is a top plan view of a detail from FIG. 9.

In the embodiment illustrated in FIGS. 9 and 10, at the inspection station 17, it is possible to connect a fixed pneumatic—electric transducer 59 to each seat 6, to issue a signal which depends on the action of the fluid and which indicates the condition of a cigarette 2. In particular, in the embodiment illustrated in FIG. 9, at the inspection station 17, the disk 9 has, in contact with its outer surface 9*a*, a third fixed manifold 60 with a through duct 61 which, during disk 9 rotation, communicates and forms an airtight seal with the through ducts 62 inside the disk 9, communicating with the caps 16 which form part of the connecting means 15. The duct 61 is connected to the pneumatic—electric transducer 59 which, in contrast to the solutions illustrated in FIGS. 1 and 5, is a single, fixed transducer.

In FIG. 10 the panel 45 has the same shape as illustrated in FIG. 8.

In this case, the fact that each seat 6 has first pneumatic connecting means 35 allows the rapid generation in each seat 6, in conjunction with the panel 45, of an environment with the desired vacuum and the establishment of the equilibrium in said environment even after the various measurements. Moreover, the measurements are not influenced by the high speed of rotation of the roller 4 and, if a cigarette 2 is missing in one of the seats 6, the vacuum equilibrium is re-stablished in relatively short times, meaning that there is no interference with the ambient conditions for said equilibrium.

What is claimed is:

1. A device for the pneumatic inspection of smoking items, comprising a conveyor with a plurality of seats, each for receiving an item and pneumatic fluid generator means which can be connected to the seats at an inspection station, subjecting the item to the action of the fluid, wherein a pressure transducer is attached to each seat, the transducer issuing at least one signal which depends on the action of the fluid and which indicates the state of the smoking item; wherein the pneumatic generator means comprise, at least at the inspection station, at least one covering hood forming, together with the conveyor, a chamber containing at least two adjacent seats, it being possible to connect the chamber to a second source of the fluid, for subjecting at least part and at least the cylindrical body of each smoking item to a variation in the ambient pressure, as a result of the action of the fluid.

2. The device according to claim 1, wherein the pneumatic generator means comprise, relative to each seat, means for connecting to the ends of each smoking item, connecting the item to a source of the fluid at least at the inspection station.

3. The device according claim 1, wherein the hood has a first portion which is smaller than the longitudinal dimension of the smoking item and covers a first of the two seats, and a second portion of a size substantially equal to the longitudinal dimension of the smoking item and covering the second of the two seats.

4. The device according to claim 1, wherein each transducer is supported by a shared support conveyor moving in such a way that it is synchronized with the conveyor which has the seats.

5. The device according to claim 4, wherein each transducer is electrically connected by a shared circuit integral with the support conveyor to a fixed distributor.

6. A device for the pneumatic inspection of smoking items, comprising a conveyor with a plurality of seats, each for receiving an item and pneumatic fluid generator means which can be connected to the seats at an inspection station, subjecting the item to the action of the fluid, wherein a pressure transducer is attached to each seat, the transducer issuing at least one signal which depends on the action of the fluid and which indicates the state of the smoking item; wherein each transducer is supported by a shared support conveyor moving in such a way that it is synchronized with the conveyor which has the seats.

7. The device according to claim 6, wherein the pneumatic generator means comprise, relative to each seat, means for connecting to the ends of each smoking item, connecting the item to a source of the fluid at least at the inspection station.

8. The device according to claim 6, wherein each transducer is electrically connected by a shared circuit integral with the support conveyor to a fixed distributor.

* * * * *